US005378041A

United States Patent [19]

Lee

[11] Patent Number: 5,378,041

[45] Date of Patent: Jan. 3, 1995

[54] WHEELCHAIR

[76] Inventor: Don W. Lee, 1330 Bennet, Pasadena, Calif. 91103-2705

[21] Appl. No.: 223,750

[22] Filed: Apr. 6, 1994

Related U.S. Application Data

[63] Continuation of Ser. No. 881,248, May 11, 1992.

[51] Int. Cl.[6] ..... A47C 7/52

[52] U.S. Cl. ..... 297/391; 297/396; 297/397; 297/423.4; 297/DIG. 4; 280/250.1; 280/304.1

[58] Field of Search ..... 280/250.1, 304.1; 297/428, 429, 438, 444, 231, DIG. 4, 423.1, 391, 396, 397, 423.18, 423.39, 423.40

[56] References Cited

U.S. PATENT DOCUMENTS

| | | | |
|---|---|---|---|
| 2,609,864 | 9/1952 | Gates, Jr. | 297/429 |
| 2,826,242 | 3/1958 | Thompson | 297/DIG. 4 |
| 3,674,310 | 7/1972 | Montagano | 280/250.1 |
| 4,176,879 | 12/1979 | Rodaway | 297/429 |
| 4,405,142 | 9/1983 | Whetstine | 280/250.1 |
| 4,565,385 | 1/1986 | Morford | 280/304.1 |
| 4,664,441 | 5/1987 | Collins | 297/DIG. 4 |
| 4,695,072 | 9/1987 | Brooks | 297/423 |
| 4,712,836 | 12/1987 | Gerber | 297/429 |
| 4,989,836 | 2/1991 | Hudson, III et al. | 297/DIG. 4 |
| 5,301,975 | 4/1994 | Rivera | 297/DIG. 4 |

*Primary Examiner*—Peter M. Cuomo
*Assistant Examiner*—Darnell M. Boucher
*Attorney, Agent, or Firm*—James E. Brunton

[57] ABSTRACT

A wheelchair construction which includes both removable patient foot supports and an outwardly extending patient leg support which can function to support the patient's legs in an upraised position when the foot supports have been removed.

The wheelchair construction also includes an easily removable inclined back support assembly having connector elements which are telescopically receivable within upstanding tubular rear members of the wheelchair mainframe for supporting the patient in a more comfortable reclined position. The leg support and inclined back support assemblies permit the wheelchair patient to shift positions and achieve a greater degree of comfort than is provided by the standard wheelchair back and foot supports.

11 Claims, 3 Drawing Sheets

FIG. 1
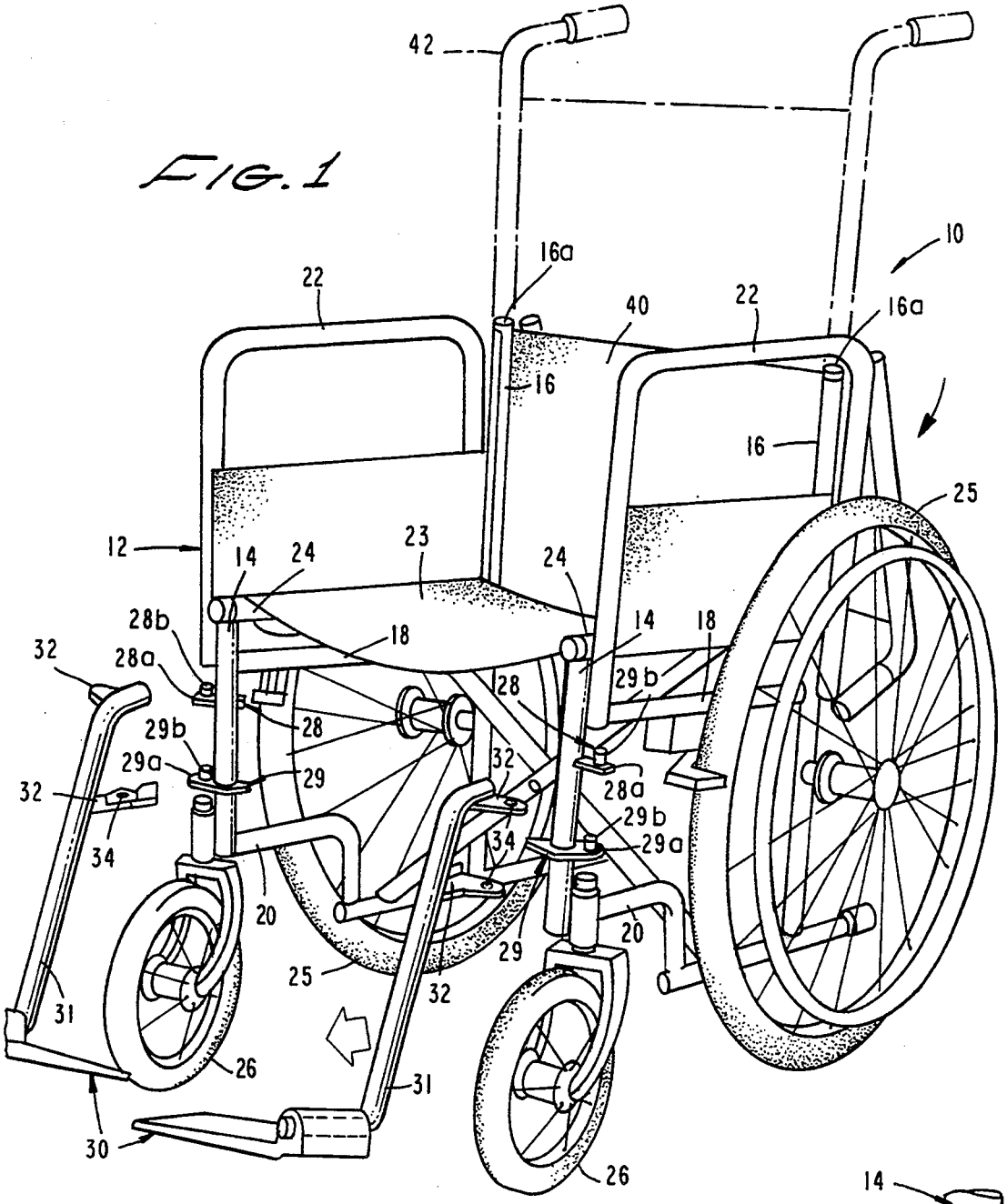
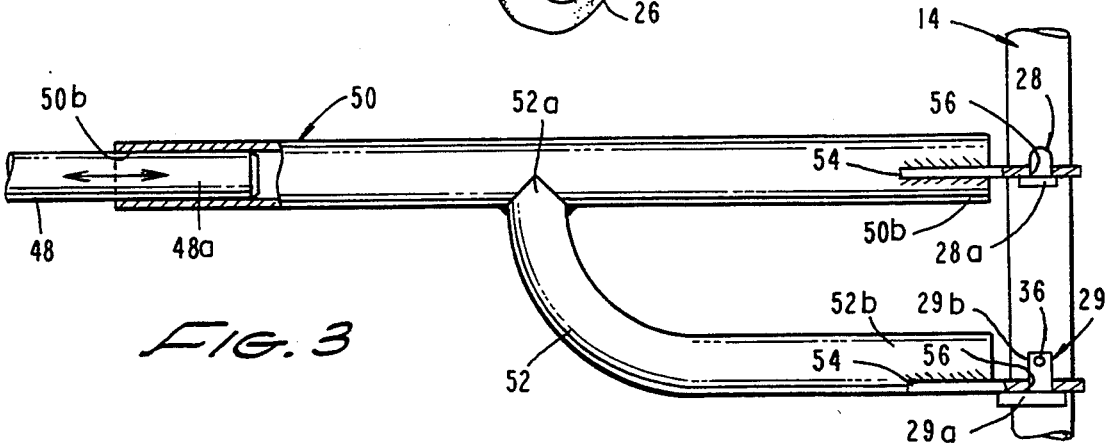
FIG. 3

WHEELCHAIR

This application is a continuation of application Ser. No. 07/881,248, filed May 11, 1992 now pending.

BACKGROUND OF THE INVENTION

1. Field of the Invention

The present invention relates generally to wheelchair construction. More particularly, the invention concerns an improved wheelchair construction having removably interconnectable leg elevating supports and a removably interconnectable reclining back support.

2. Discussion of the Invention

Most commercially available wheelchairs have a relatively standard supporting structure. The supporting structure is typically constructed of lightweight metal tubing and includes side frames, a mainframe to which wheels, arm supports and push handles are connected. A seat and back is also carried by the mainframe for supporting the patient in a generally upright seated position. Removably connected to the front members of the mainframe are patient foot supports which support the feet of the patient while seated in the wheelchair. These supports can usually be removed or swung to one side when the patient rises from or is being seated in the wheelchair.

The back support generally comprises upper and lower back support subassemblies. The lower back support subassembly is typically disposed between upwardly extending portions of the rear members of the mainframe and functions to support the lower portion of the patient's back in a substantially upright position so as to maintain correct posture. The upper back support subassembly is usually pivotally connected to the rear members of the mainframe and is movable between a downwardly folded stowed position and an upwardly extending support position wherein the upper back support is substantially coplanar with the lower back support. Typically the push handles extend rearwardly from the upper extremities of the upper back support subassembly.

The patient leg elevating attachment of the preferred form of the present invention is removable connected directly to rigid connector brackets which are provided on the front members of the mainframe. These brackets normally support the standard wheelchair foot supports but also accept the leg elevating attachment when the foot supports have been removed. Similarly, the novel, rearwardly sloping back support attachment of the present invention is provided with angular shaped connector portions that are telescopically receivable directly within the tubular rear members of the wheelchair mainframe. Accordingly, the accessories of the present invention are uniquely designed to be directly usable with wheelchairs of standard construction without the necessity of in any way modifying the basic wheelchair construction.

Applicant is aware of the following patents which describe various types of wheelchair attachments and modifications: U.S. Pat. No. 4,712,836 issued to Gerber; U.S. Pat. No. 4,654,904 issued to Britz; U.S. Pat. No. 4,572,577 issued to La Rue; U.S. Pat. No. 4,125,269 issued to Keil; U.S. Pat. No. 3,858,938 issued to Kristensson et al.; and U.S. Pat. No. 2,609,864 issued to Gates.

SUMMARY OF THE INVENTION

Patients who are required to sit in wheelchairs for long periods of time are prone to developing leg, ankle, and feet swelling, as well as pain and discomfort from sitting for long periods in one position. It is difficult for wheelchair patients to obtain relief by moving to a conventional sofa or chair because, without the availability of the wheelchair arm rests, the patient does not have the leverage to safely rise from the conventional seating. Therefore, it is generally more convenient for the person to remain in the wheelchair than to try to move to a more comfortable chair or sofa.

The thrust of the present invention is to provide accessories for the standard wheelchair which permit the patient to at once be made much more comfortable while still remaining in the wheelchair. This is accomplished by providing specially designed back and leg support attachments which permit raising of the patient's legs while the patient reclines to a more comfortable position. With the legs raised and back reclined, the patient can stretch and shift to more comfortable positions. At the same time elevation of the patients legs reduces leg swelling and improves blood circulation.

It is an object of the present invention to provide a wheelchair which includes both removable patient foot supports and an outwardly extending patient leg support which can function to support the patients legs in an upraised position when the foot supports have been removed.

It is another object of the invention to provide a wheelchair of the aforementioned character which includes a back support having connector elements which are telescopically receivable within the tubular rear members of the wheelchair mainframe for supporting the patient in a more comfortable reclined position.

It is another object of the invention to provide a wheelchair of the type described in the preceding paragraphs which is reliable in use and one in which the back support and leg support accessories are easily connected to and disconnected from the basic supporting framework of the wheelchair.

Another object of the present invention is to provide a wheelchair construction in which the back rest and leg elevating accessories described in the preceding paragraphs are light weight and easy to use and store.

Still another object of the invention is to provide back rest and leg elevation accessories of the character described which are of simple design and are inexpensive to manufacture.

BRIEF DESCRIPTION OF THE DRAWINGS

FIG. 1 is a generally perspective view of a wheelchair of standard construction.

FIG. 3 is a greatly enlarged view partly in cross-section of the rearward portion of the leg elevating accessory of the invention showing the manner of interconnection of the accessory with the standard wheelchair mainframe.

DESCRIPTION OF ONE FORM OF THE INVENTION

Figures 6, 7, 8:
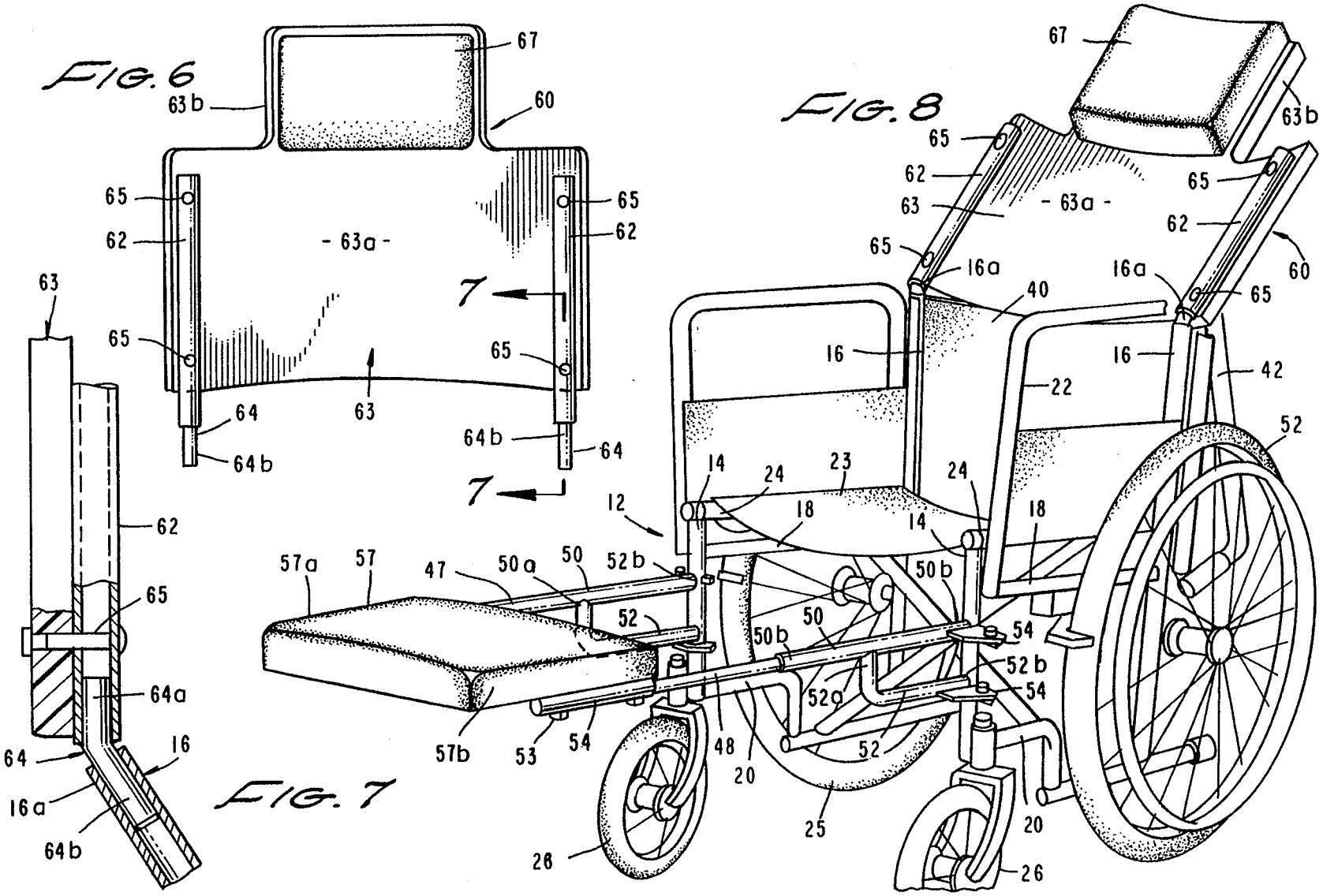
FIG. 6 is a front view of the back rest accessory of the invention.
FIG. 7 is an enlarged cross-sectional view taken along lines 7—7 of FIG. 6.
FIG. 8 is a generally perspective view of the standard wheelchair having the leg elevation and back rest accessories of the present invention removably interconnected therewith.

Referring to the drawings and by comparing FIGS. 1 and 8, it can be seen that the novel backrest and leg elevating accessories of the present invention are usable in connection with a standard wheelchair of the character shown in FIG. 1. The standard wheel chair construction includes a patient supporting structure 10 comprising a mainframe 12 having transversely spaced apart pairs of front and rear upstanding tubular members 14 and 16 respectively. As best seen in FIG. 1, each of the front and rear members 14 and 16 are interconnected by generally horizontally extending upper and lower tubular members 18 and 20. Connected on either side of mainframe 12 are "U" shaped arm supporting side frames generally identified in FIG. 1 by the numeral 22. A canvas seat 23 spans a pair of transversely spaced top members 24 which are carried by front and rear mainframe members 14 and 16. Large diameter wheels 25 are rotatably connected to mainframe 12 as are smaller diameter, pivotally mounted front wheels 26.

In the standard wheelchair construction shown in FIG. 1, a pair of patient foot support assemblies 30 are typically removably connected to the wheelchair superstructure by cooperating connector means provided on the foot supports and on the front members 14 of the mainframe 12. More particularly, each front member 14 is provided with upper and lower connector elements 28 and 29 respectively. Connector elements 28 each include a plate like member 28*a* which is affixed as by welding to the outboard side of each front member 22. Connector elements 28 also include an upstanding, generally cylindrically-shaped protruberance 28*b* of the character best seen in FIG. 3. Connector elements 29 also include a plate like member 29*a* which circumscribes members 22 and further include an upstanding generally cylindrically-shaped protruberance 29*b* (FIG. 3). The foot support connector means of the invention also comprise vertically spaced connector tabs 32 which are provided on the tubular shaped members 31 of each of the foot support assemblies 30. Each connector tab 32 has a centrally disposed aperture 34 which is closely receivable over protruberances 28*b* and 29*b* of the wheelchair mainframe in the manner best seen in FIG. 2. As shown in FIG. 3 lower protruberances 29*b* are provided with a detent assembly 36 which prevents accidental disengagement of the foot supports 30 from the wheelchair mainframe.

The standard wheelchair shown in FIG. 1 also includes a backrest 40 which spans rear members 40 of the mainframe and functions to normally support the lower back of the patient. Pivotally connected to mainframe 12 is a combination push frame and upper back support assembly 42. As indicated by the phantom lines in FIG. 1, assembly 42 is pivotally movable from an upright, push position (phantom lines) to a downwardly extending stowed position (solid lines).

Figures 2, 4, 5:
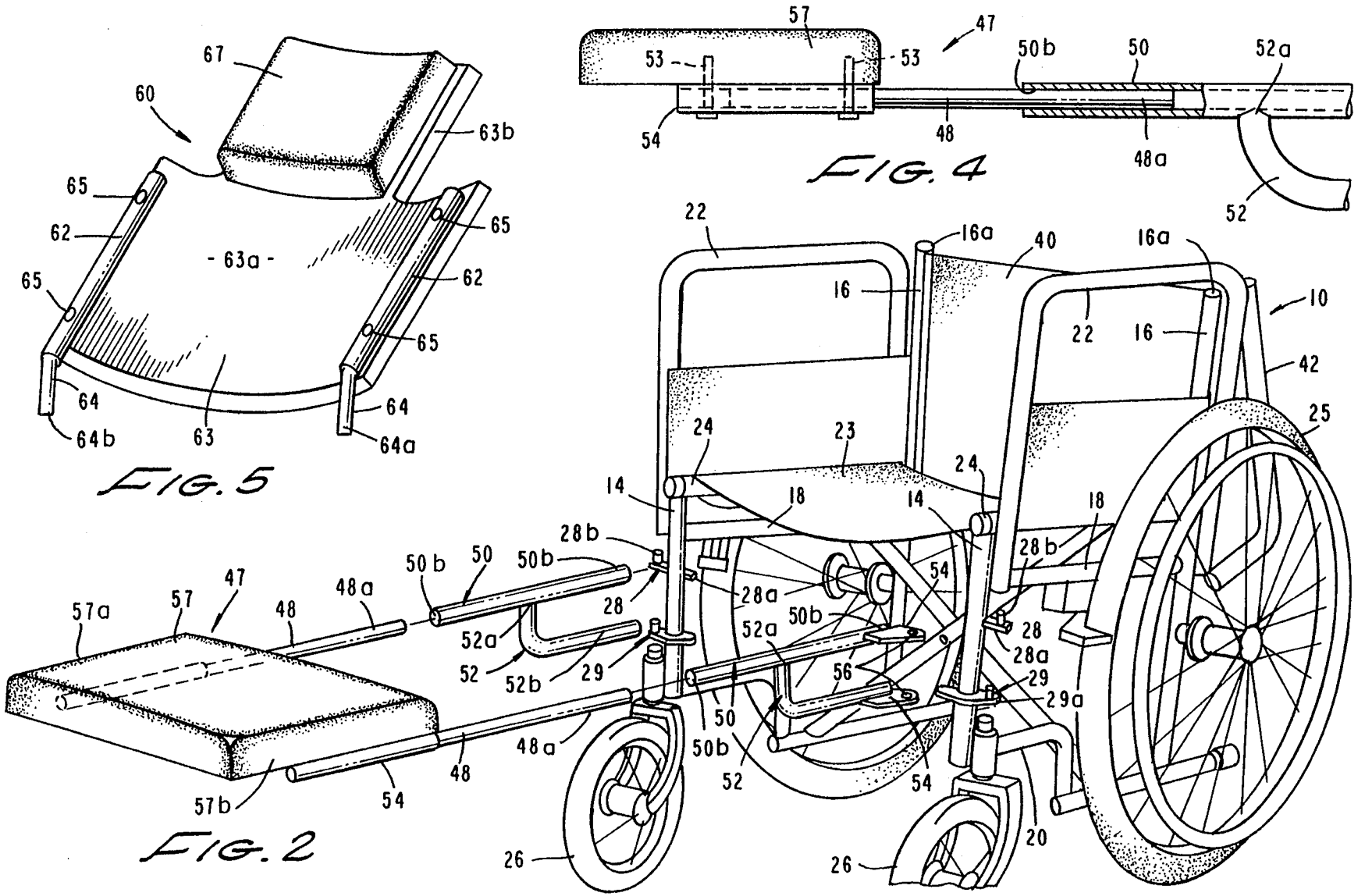
FIG. 2 is a generally perspective view of the standard wheelchair laving the upper back support subassembly pivoted into a stowed position, the feet support positions of the wheelchair removed and the leg elevation accessory of the present invention positioned for interconnection with the front mainframe members of the standard wheelchair.
FIG. 4 is a fragmentary side elevational view of the forward portion of the leg accessory of the invention partly broken away to show internal construction.
FIG. 5 is a generally perspective view of the back rest accessory of the present invention.

Turning now to FIGS. 2, 3 and 4 an important feature of the apparatus of the present invention is the patient leg support assembly 47 which is removably interconnectable with the mainframe 12 of the standard wheelchair. In the form of the invention shown in the drawings, the patient leg support or leg elevating assembly comprises a pair of spaced apart, forwardly extending support members each comprising a forward tubular segment 48 and a rearward tubular segment 50. As indicated in FIG. 3, tubular segment 48 is telescopically receivable within tubular segment 50 so that the segments can be joined together in the manner illustrated in FIG. 3. A generally L shaped tubular member 52 is connected at its first end 52*a* to each of the tubular members 50 so that its second end 52*b* is vertically spaced from the inboard or second end 50*b* of tubular member 50. A connector tab 54 is connected proximate ends 50*b* and 52*b* of each of the leg support assemblies. Each connector tab 54 is provided with an aperture 56 which is closely receivable over protuberances 28*b* and 29*b* in the same manner that connectors 32 of the foot supports are received thereover (FIG. 3). With this construction, once patient foot support assemblies 30 have been disconnected from the mainframe of the wheelchair, forwardly extending support members 50 and 52 maybe interconnected with the mainframe by positioning apertures 56 of connector tabs 54 over protruberances 28*b* and 29*b* in the manner shown in FIG. 3.

A transverse leg engagement member 57 having a first margin 57*a* and a second margin 57*b* is interconnected with tubular segments 48 in the manner shown in FIGS. 2 and 4. More particularly, fasteners 53 extend through aligned apertures provided in connector sleeves 54 and tubular segments 48 and into fastening engagement with the marginal portions 57*a* and 57*b* of leg engagement member 57.

As best seen by referring to FIG. 2, the assembly made up of tubular segments 48 and leg support member 57 can be interconnected with the assemblage made up of tubular members 50 and 52 by simply inserting ends 48*a* of tubular members 48 into first ends 50*b* of tubular members 50. The positioning of leg support member 57 relative to the mainframe can be adjusted to suit the particular patient by telescopic movement of tubular members 48 into and out of tubular segments 50.

A second important feature of the apparatus of the present invention is the specially designed patient back support assembly 60 which is removably interconnected with upstanding rear members 16 of the mainframe of the wheelchair superstructure. Turning particularly to FIGS. 5, 6, and 7, the unique back support assembly of the present form of the invention comprises a pair of spaced apart, upwardly extending rigid tubular members 62 to which a curved back support 63 is affixed by means of suitable connectors 65. The back support assembly also includes a generally cylindrically shaped rigid member 64 having an upper portion 64*a* and a lower portion 64*b* which extends at an obtuse angle with respect to portion 64*a*. As best seen by referring to FIG. 7, portion 64*a* of each member 64 is closely receivable within tubular members 62 while portion 64*b* of each member 64 is telescopically receivable within the open end upper portions 16*a* of rear mainframe members 16.

As best seen by referring to FIG. 5, the rigid panel 63 of the back rest comprises a central body portion 63*a* and an intregal head support portion 63*b*. Affixed to head support portion 64*b*, which is of a width less than body portion 63*a*, is a padded head support 67 which comfortably supports the patient's head when the patient is in the reclined position permitted by the uniquely configured, rearwardly sloping back support accessory of the invention.

It is to be appreciated that the patient's back support assembly can be quickly and easily removed from the wheelchair mainframe by lifting the assemblage upwardly to a position that portion 64*b* of the connector elements 64 clear tubular members 16 of the mainframe. Once the back support has been removed, the stowed back rest assembly 42 can be swung into the operative position illustrated by the phantom lines in FIG. 1.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A wheelchair, comprising:

(a) a patient supporting structure including a mainframe having transversely spaced pairs of upstanding front and rear members;

(b) wheels rotatably connected to said patient supporting structure;

(c) a foot support assembly removably connected to each of said front members of said mainframe, said foot support assembly including a foot support connector tab;

(d) a connector element provided on each said front member of said mainframe for cooperative engagement with one of said connector tabs of one of said foot supports;

(e) a patient leg support removably connected to said patient supporting structure, said patient leg support comprising:

(i) a pair of spaced-apart, forwardly extending support members;

(ii) a leg support connector tab provided on each said support member for cooperative engagement with one of said connector elements provided on said front members of said mainframe;

(iii) a transverse member having a first margin connected to one of said support members and a second margin connected to the other of said support members; and (f) a patient back support assembly removably interconnectable with said mainframe, said back support comprising:

(i) a pair of spaced-apart, upwardly-extending, rigid members;

(ii) a pair of connectors each having first and second portions, said second portions extending at an obtuse angle with respect to said first portions, said first portions of said connectors being telescopically receivable within said upwardly extending rigid members and said second portion being telescopically receivable within the upstanding rear members of said mainframe; and (iii) a patient back support having a first margin connected to one of said upwardly extending rigid members and a second margin connected to the other of said upwardly extending rigid members.

2. A wheelchair as defined in claim 1 in which each of said forwardly extending support members comprises first and second telescopically interconnected tubular segments.

3. A wheelchair as defined in claim 2 in which said transverse member of said patient leg support comprises a padded leg and foot support spanning said second tubular segments of said support members.

4. A wheelchair as defined in claim 3 in which said patient back support comprises a rearwardly curved rigid panel having a body portion of a first width and an integral head support portion of a second lessor width.

5. A wheelchair as defined in claim 4 further including a second back support structure pivotally connected to said patient supporting structure for movement between a first lower position and a second upstanding position.

6. A patient back support assembly for use in connection with a wheelchair of the character having a patient supporting structure including a mainframe having transversely spaced pairs of rear members and wheels rotatably connected to said patient supporting structure, said patient back assembly being removably connectable to said wheelchair and comprising:

(a) a pair of spaced-apart, upwardly-extending rigid members;

(b) a pair of connectors each having first and second portions, said second portions extending at an obtuse angle with respect to said first portions, said first portions of said connectors being telescopically receivable within said upwardly extending rigid members and said second portion being telescopically receivable within the upstanding rear member of said mainframe; and (c) a patient back support having a first margin connected to one of said upwardly extending rigid members and a second margin connected to the other of said upwardly extending rigid members.

7. A patient back support assembly as defined in claim 6 in which said patient back support comprises a rearwardly curved rigid panel.

8. A patient back support assembly as defined in claim 7 in which said rigid panel includes a body portion and an integral head support portion.

9. A patient back support assembly as defined in claim 8 further including a padded head support connected to said head support portion of said rigid panel.

10. A wheelchair having a patient support structure including a mainframe having a pair of upstanding front members and a pair of upstanding rear members, the front members each having a side connector for removably connecting a foot support thereto, the improvement comprising:

(a) a patient leg support removably interconnectable with the connectors provided on the front members of the mainframe, said patient leg support comprising:

(i) a pair of spaced-apart, forwardly extending support members of substantially equal length;

(ii) leg support connector means provided on each support member of said pair of support members with the connectors provided on the front members of the mainframe so that said support members extend generally horizontally outwardly from the patient supporting structure;

(iii) a transverse leg engagement member having a first margin connected to one of said support members and a second margin connected to the other of said support members; and (b) a patient back support assembly removably interconnectable with the mainframe, said back support comprising:

(i) a pair of spaced-apart support members removably interconnected with the upstanding rear members of the mainframe; and (ii) a patient back support angularly disposed relative to said support members at an angle greater than 90 degrees wherein said back support is angularly disposed relative to said upstanding rear members of the mainframe, said back support having a first margin connected to one of said upwardly extending support members and a second margin connected to the other of said upwardly extending support members.

11. A wheelchair, comprising:

(a) a patient supporting structure including a mainframe having transversely spaced pairs of upstanding front and rear members;

(b) wheels rotatably connected to said patient supporting structure;

(c) a foot support assembly removably connected to each of said front members of said mainframe;

(d) a connector means provided on each said front member of said mainframe for connecting said foot supports thereto;

(e) a patient leg support removably connected to said patient supporting structure, said patient leg support comprising:

(i) a pair of spaced-apart, forwardly extending support members; and (ii) a leg support connector means provided on each said support member for cooperative engagement with one of said connector means provided on said front members of said mainframe;

(f) a patient back support assembly removably interconnectable with said mainframe, said back support comprising:

(i) a pair of spaced-apart, upwardly-extending, rigid members;

(ii) a pair of connectors each having first and second portions, said second portions extending at an obtuse angle with respect to said first portions, said first portions of said connectors being telescopically receivable within said upwardly extending rigid members and said second portion being telescopically receivable within the upstanding rear members of said mainframe; and (iii) a patient back support having a first margin connected to one of said upwardly extending rigid members and a second margin connected to the other of said upwardly extending rigid members.

* * * * *